US010619804B2

(12) United States Patent
York et al.

(10) Patent No.: US 10,619,804 B2
(45) Date of Patent: Apr. 14, 2020

(54) INTEGRATED CAPS FOR POLE-MOUNTED LIGHT FIXTURES

(71) Applicant: Eaton Intelligent Power Limited, Dublin (IE)

(72) Inventors: Chenell Erika York, Atlanta, GA (US); Nam Chin Cho, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/013,272

(22) Filed: Jun. 20, 2018

(65) Prior Publication Data

US 2018/0363863 A1 Dec. 20, 2018

Related U.S. Application Data

(60) Provisional application No. 62/522,311, filed on Jun. 20, 2017.

(51) Int. Cl.

| | |
|---|---|
| ***F21S 2/00*** | (2016.01) |
| ***F21S 8/00*** | (2006.01) |
| ***F21S 8/08*** | (2006.01) |
| ***F21V 17/12*** | (2006.01) |
| ***F21V 23/04*** | (2006.01) |
| ***F21V 23/00*** | (2015.01) |

(52) U.S. Cl.

CPC ..... *F21S 2/00* (2013.01); *F21S 8/006* (2013.01); *F21S 8/032* (2013.01); *F21S 8/085* (2013.01); *F21V 17/12* (2013.01); *F21V 23/008* (2013.01); *F21V 23/045* (2013.01); *F21V 23/0442* (2013.01)

(58) Field of Classification Search

CPC .... F21S 2/00; F21S 8/085; F21S 8/032; F21S 8/006; F21V 23/008; F21V 23/0442; F21V 23/045; F21V 17/12

See application file for complete search history.

(56) References Cited

U.S. PATENT DOCUMENTS

| | | | | |
|---|---|---|---|---|
| 7,731,383 | B2 * | 6/2010 | Myer | F21S 8/083 362/145 |
| 2012/0143383 | A1 * | 6/2012 | Cooperrider | H04Q 9/00 700/295 |
| 2012/0154239 | A1 * | 6/2012 | Bar-Sade | H01Q 1/1242 343/839 |
| 2013/0083516 | A1 * | 4/2013 | Yoon | F21V 29/74 362/190 |
| 2015/0346320 | A1 * | 12/2015 | Hartman | H05B 37/0227 315/312 |

(Continued)

*Primary Examiner* — Kevin Quarterman
(74) *Attorney, Agent, or Firm* — King & Spalding LLP

(57) ABSTRACT

An integrated cap for retrofitting an existing light fixture can include an integrated cap housing that is configured to be disposed atop a pole that supports the existing light fixture, where the integrated cap housing includes a communication module and a transceiver. The integrated cap can also include a first coupling feature disposed at a bottom end of the integrated cap housing, where the first coupling feature is configured to couple to a first component of the existing light fixture to provide electrical signals to the communication module and the transceiver, where the communication module and the transceiver communicate with a second component external to the existing light fixture.

15 Claims, 6 Drawing Sheets

(56) References Cited

U.S. PATENT DOCUMENTS

| | | | | |
|---|---|---|---|---|
| 2015/0349399 | A1* | 12/2015 | Lasier | H01Q 1/06 343/721 |
| 2016/0131358 | A1* | 5/2016 | Spiro | H04W 88/08 455/561 |
| 2017/0122546 | A1* | 5/2017 | Abbott | F21S 8/086 |

* cited by examiner

INTEGRATED CAPS FOR POLE-MOUNTED LIGHT FIXTURES

CROSS-REFERENCE TO RELATED APPLICATIONS

This application claims priority under 35 U.S.C. § 119 to U.S. Provisional Patent Application Ser. No. 62/522,311, titled "Integrated Caps For Pole-Mounted Light Fixtures" and filed on Jun. 20, 2017, the entire contents of which are hereby incorporated herein by reference.

TECHNICAL FIELD

The present disclosure relates generally to control systems for light fixtures, and more particularly to systems, methods, and devices for caps for light poles for existing outdoor light fixtures.

BACKGROUND

Outdoor light fixtures mounted on poles (e.g., street lights) have been in existence for decades. These outdoor light fixtures in many cases use old technology. Even such outdoor light fixtures that have relatively new lighting technology (e.g., light-emitting diodes (LEDs)) can lack connectivity from a communication standpoint. Replacing the entire light fixture, or even just the operable components (e.g., light sources, power supply) can be expensive.

SUMMARY

In general, in one aspect, the disclosure relates to a retrofitted light fixture. The retrofitted light fixture can include a pole that supports an existing light fixture, where the pole includes a sensor coupling feature disposed atop the pole. The retrofitted light fixture can also include a sensor device for the existing light fixture, where the sensor device includes a pole coupling device that is configured to couple to the sensor coupling feature of the pole as part of the existing light fixture. The retrofitted light fixture can further include an integrated cap having a first coupling feature and a second coupling feature, where the first coupling feature is disposed at a bottom end of the integrated cap and is coupled to the sensor coupling feature of the pole, where the second coupling feature is disposed at a top end of the integrated cap and is coupled to the pole coupling device of the sensor device, where the integrated cap comprises a communication module and a transceiver for communicating with a component external to the existing light fixture.

In another aspect, the disclosure can generally relate to a retrofitted light fixture. The retrofitted light fixture can include a pole that supports an existing light fixture. The retrofitted light fixture can also include an integrated cap having a coupling feature, where the integrated cap is disposed atop the pole, where the coupling feature is coupled to a light fixture component of the existing light fixture, where the light fixture component provides electrical signals to the integrated cap, where the integrated cap includes a communication module and a transceiver for communicating with an external component that is external to the existing light fixture, and where the communication module and the transceiver operate using the electrical signals.

In yet another aspect, the disclosure can generally relate to an integrated cap for retrofitting an existing light fixture. The integrated cap can include an integrated cap housing that is configured to be disposed atop a pole that supports the existing light fixture, where the integrated cap housing includes a communication module and a transceiver. The integrated cap can also include a first coupling feature disposed at a bottom end of the integrated cap housing, where the first coupling feature is configured to couple to a first component of the existing light fixture to provide electrical signals to the communication module and the transceiver, where the communication module and the transceiver are configured to communicate with a second component external to the existing light fixture.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
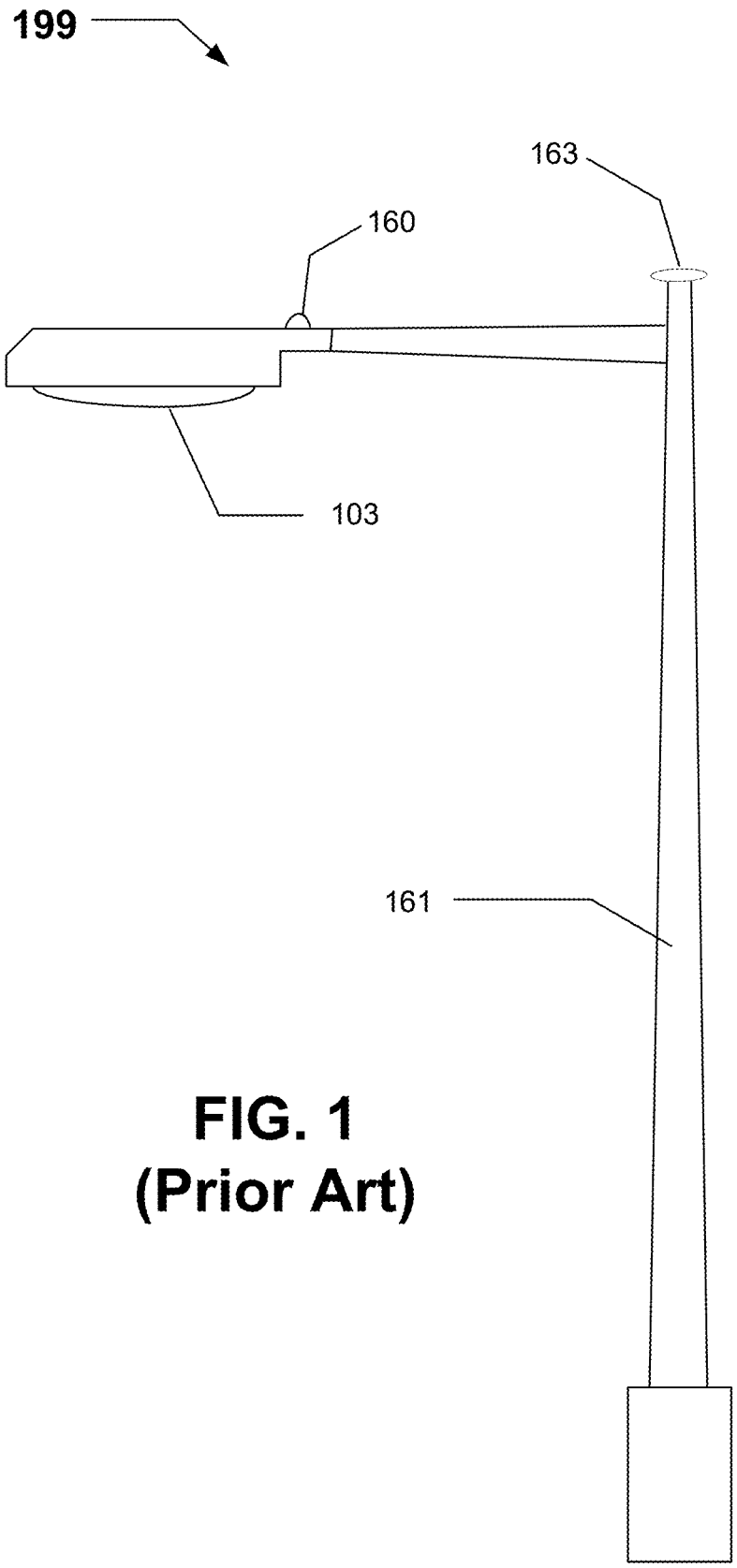
FIG. 1 (Prior Art)
FIGS. 1-3 show outdoor light fixtures that are currently known in the art.

In general, example embodiments provide systems, methods, and devices for integrated caps for existing light fixtures. Example integrated caps for existing light fixtures provide a number of benefits. Such benefits can include, but are not limited to, prolonging the life and functionality of an existing light fixture, increased reliability of the light fixture, reduced power consumption, improved communication efficiency, ease of installation, ease of maintenance, and compliance with industry standards that apply to light fixtures located in certain environments. The term "light fixture" is sometimes abbreviated as "LF" herein.

Generally speaking, this application is directed to an integrated cap for an existing light fixture that allows the light fixture to transform from a light fixture that cannot communicate (e.g., send and receive data, instructions, and communication signals) to a light fixture that can communicate. In some cases, example embodiments can also transform a "dumb" light fixture to a "smart" light fixture. The specific examples provided herein are directed to an existing light fixture that cannot communicate and/or be remotely controlled in its current state, where the integrated cap can easily be installed, often without the use of tools, to allow the retrofitted light fixture to be remotely and wirelessly communicative and/or controlled.

Existing light fixtures with which example integrated caps can be used can be located in one or more of any of a number of environments. Examples of such environments can include, but are not limited to, indoors, outdoors, a parking lot, a park, a path, an open space, a street, a highway, an office space, a manufacturing plant, a warehouse, and a storage facility, both climate-controlled and non-climate-controlled. In some cases, the example embodiments discussed herein can be used in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill.

Example integrated caps can be integrated into a pole on which an existing light fixture is mounted. Alternatively, example integrated caps can be used with existing light fixtures that are mounted on some other structure aside from a pole. In any case, example integrated caps described herein can be mounted on the housing of an existing light fixture or mounted remote from (but proximate to) the housing of an existing light fixture. A user may be any person that interacts with existing light fixtures and/or example integrated caps. Examples of a user may include, but are not limited to, an engineer, an electrician, an instrumentation and controls technician, a mechanic, an operator, a property manager, a homeowner, a tenant, an employee, a consultant, a contractor, and a manufacturer's representative.

The existing light fixtures with example integrated caps (including components thereof) can be made of one or more of a number of suitable materials to allow the light fixture to meet certain standards and/or regulations while also maintaining durability in light of the one or more conditions under which the light fixtures and/or other associated components of the light fixture can be exposed. Examples of such materials can include, but are not limited to, aluminum, stainless steel, fiberglass, glass, plastic, ceramic, and rubber.

Example integrated caps, or portions thereof, described herein can be made from a single piece (as from a mold, injection mold, die cast, or extrusion process). In addition, or in the alternative, example integrated caps can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example integrated cap to become coupled, directly or indirectly, to a sensor, a pole, a housing of an existing light fixture, and/or some other feature of an existing light fixture. A coupling feature can include, but is not limited to, a clamp, a portion of a hinge, an aperture, a recessed area, a protrusion, a hole, a slot, a tab, a detent, and mating threads. One portion of an example integrated cap can be coupled to a sensor, a pole, a housing of an existing light fixture, and/or some other feature of an existing light fixture by the direct use of one or more coupling features.

In addition, or in the alternative, a portion of an example integrated cap can be coupled to a sensor, a pole, a housing of an existing light fixture, and/or some other feature of an existing light fixture using one or more independent devices that interact with one or more coupling features disposed on a component of the integrated cap. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of integrated caps for existing light fixtures, one or more of the components shown may be omitted, repeated, and/or substituted. Accordingly, example embodiments of integrated caps for existing light fixtures should not be considered limited to the specific arrangements of components shown in any of the figures. For example, features shown in one or more figures or described with respect to one embodiment can be applied to another embodiment associated with a different figure or description.

In certain example embodiments, retrofitted light fixtures having example integrated caps are subject to meeting certain standards and/or requirements. For example, the National Electric Code (NEC), the National Electrical Manufacturers Association (NEMA), the International Electrotechnical Commission (IEC), the Federal Communication Commission (FCC), Underwriters Laboratories (UL), and the Institute of Electrical and Electronics Engineers (IEEE) set standards as to electrical enclosures, wiring, and electrical connections. Use of example embodiments described herein meet (and/or allow the retrofitted light fixture to meet) such standards when applicable.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of integrated caps for existing light fixtures will be described more fully hereinafter with reference to the accompanying drawings, in which example embodiments of integrated caps for existing light fixtures are shown. Integrated caps for existing light fixtures may, however, be embodied in many different forms and should not be construed as limited to the example embodiments set forth herein. Rather, these example embodiments are provided so that this disclosure will be thorough and complete, and will fully convey the scope of integrated caps for existing light fixtures to those of ordinary skill in the art. Like, but not necessarily the same, elements (also sometimes called components) in the various figures are denoted by like reference numerals for consistency.

Terms such as "first", "second", "above", "below", "distal", "proximal", "end", "top", "bottom", "side", and "within" are used merely to distinguish one component (or part of a component or state of a component) from another. Such terms are not meant to denote a preference or a particular orientation, and are not meant to limit embodiments of integrated caps for existing light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
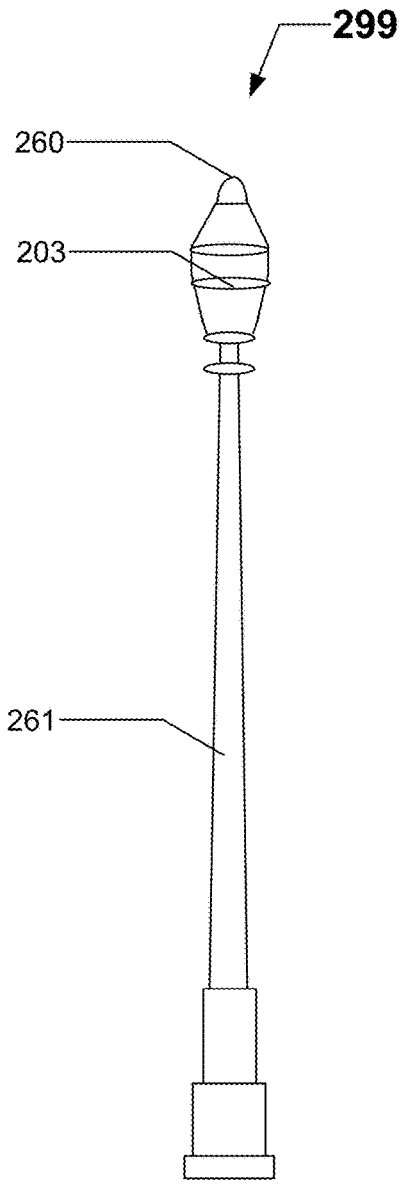
FIG. 2 (Prior Art)
Figure 3:
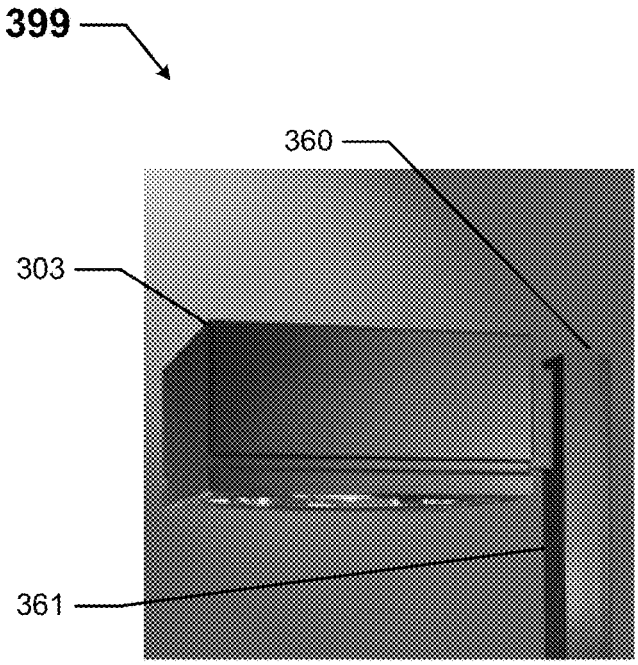
FIG. 3 (Prior Art)

FIGS. 1-3 show various existing light fixtures that are not capable of communication with other components of a lighting system. Specifically, FIG. 1 shows an existing street light 199. FIG. 2 shows an existing light fixture 299 used in a park or walkway. FIG. 3 shows an existing light fixture 399 used in a parking lot.

The existing light fixture 199 of FIG. 1 includes an existing light fixture housing 103 that is mounted on a pole 161. There is a cap 163 atop the pole 161. The light fixture housing 103 has a sensor device 160 (e.g., a photocell) disposed thereon. The existing light fixture 299 of FIG. 2 includes an existing light fixture housing 203 that is mounted on top of a pole 261. The light fixture housing 203 has a sensor device 260 (e.g., a photocell) disposed atop thereof. The existing light fixture 399 of FIG. 3 includes an existing light fixture housing 303 that is mounted on a pole 361. There is a sensor device 360 (e.g., a photocell) disposed atop the pole 361, proximate to but not directly coupled to the light fixture housing 303.

Figure 4A:
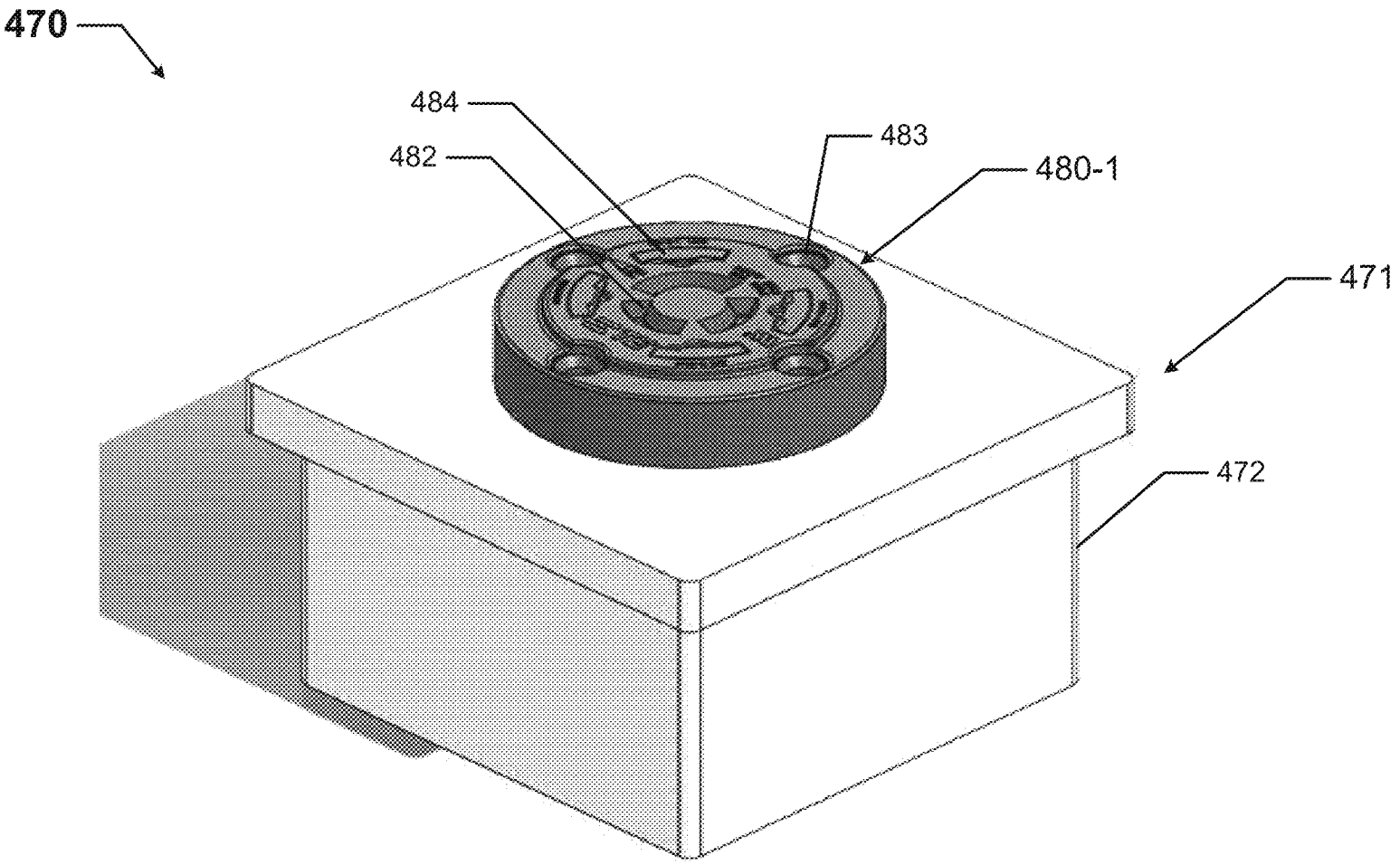
FIGS. 4A and 4B show an example integrated cap in accordance with certain example embodiments.
Figure 4B:
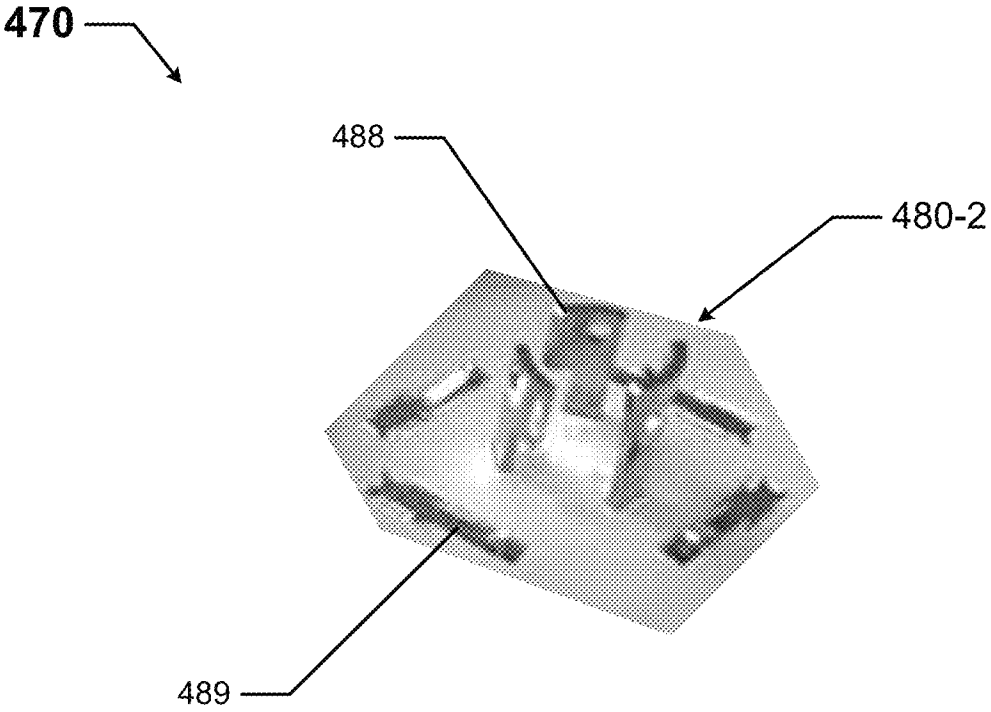

FIGS. 4A and 4B show an integrated cap 470 in accordance with certain example embodiments. Specifically, FIG. 4A shows a top-side-front perspective view of the integrated cap 470, and FIG. 4B shows a bottom-side-front perspective view of the integrated cap 470. Referring to FIGS. 1-4B, the integrated cap 470 has a housing 471 that includes at least one wall 472 that forms a cavity. Within the cavity of the housing 471 can be disposed one or more of a number of components (e.g., a transceiver, electrical conductors, a controller). Disposed on the housing 471 can be one or more coupling features (e.g., coupling feature 480-1, coupling feature 480-2). Such coupling features can be used to transmit power and/or communication signals between the integrated cap 470 and another component (e.g., a sensor device, an electrical cable) of a lighting system for a light fixture.

In certain example embodiments, the example integrated cap 470 is configured to be disposed atop a pole (e.g., pole 161, pole 261, pole 361) of a light fixture, regardless of whether there is a sensor device disposed atop the pole of the existing light fixture (as shown in FIGS. 2 and 3) or not (as shown in FIG. 1). The shape, size, color, and other characteristics of the housing 471 of the integrated cap 470 can be substantially similar to the corresponding characteristics of the pole atop which the integrated cap 470 is disposed. In this way, the integrated cap 470 can integrate seamlessly with the pole when installed.

When the integrated cap 470 is installed between the top of a pole and a sensor device of an existing light fixture, the coupling feature 480-1 disposed on the top surface of the housing 471 of the integrated cap 470, as shown in FIG. 4A, can have substantially the same shape, size, and configuration as the coupling feature of the existing sensor device disposed at the top of the pole. Similarly, as shown in FIG. 4B, the coupling feature 480-2 disposed on the bottom surface of the housing 471 of the integrated cap 470 can have substantially the same shape, size, and configuration as the coupling feature of the sensor device. In such a case, the integrated cap 470 can also be referred to as an adapter.

Each coupling feature 480 of the integrated cap 470 can have any of a number of configurations. For example, the coupling feature 480-1 shown in FIG. 4A is a standard 7-pin photocell receptacle (PCR) for receiving a photocell. The coupling feature 480-1 of FIG. 4A has a total of 7 receivers. Three of the receivers 482 of the coupling feature 480-1 of FIG. 4A are used to transmit power, and the other four of the receivers 484 of the coupling feature 480-1 of FIG. 4A are used to transmit control/data signals. As another example, the coupling feature 480-2 shown in FIG. 4B is a standard 7-pin male PCR having three inner pins 488 oriented around a center point and four shorter outer pins 489 oriented around the center point outside of the inner pins 488. A coupling feature 480 can be disposed on the housing 471 of the integrated cap 470 using one or more other coupling features (e.g., apertures 483, fastening devices (e.g., screws)).

When the integrated cap 470 is installed atop a pole that has no sensor device, then the top surface of the housing 471 of the integrated cap 470 can be featureless, while the bottom surface of the housing 471 of the integrated cap 470 can have a coupling feature 480 (e.g., coupling feature 480-2) that allows the integrated cap 470 to receive power and/or communication signals from a source (e.g., an electrical cable, an electrical connector) that provides power to the existing light fixture. Such a coupling feature 480 of the integrated cap 470 can be any type of coupling feature that both electrically and mechanically couples to a component (e.g., a power source that delivers AC mains or other form of primary power) of an existing light fixture. Examples of such a coupling feature 480 can include, but are not limited to, an electrical connector end and an inductive circuit (an inductor and electrical wiring).

The cavity of the housing 471 of the integrated cap 470 can have disposed therein one or more of a number of components. Such components are used to convert an existing light fixture that has no external communication capabilities and/or no or limited means of automatic or remote control by a user to a retrofitted light fixture that can communicate and/or be controlled remotely by a user. Such components can include, but are not limited to, a controller, a communication module, a timer, an energy metering module, a power module, a storage repository, a hardware processor, a memory, a transceiver, an application interface, and, a security module. More details about the housing 471 of the integrated cap 470 and its components are provided below with respect to FIG. 5.

Figure 5:
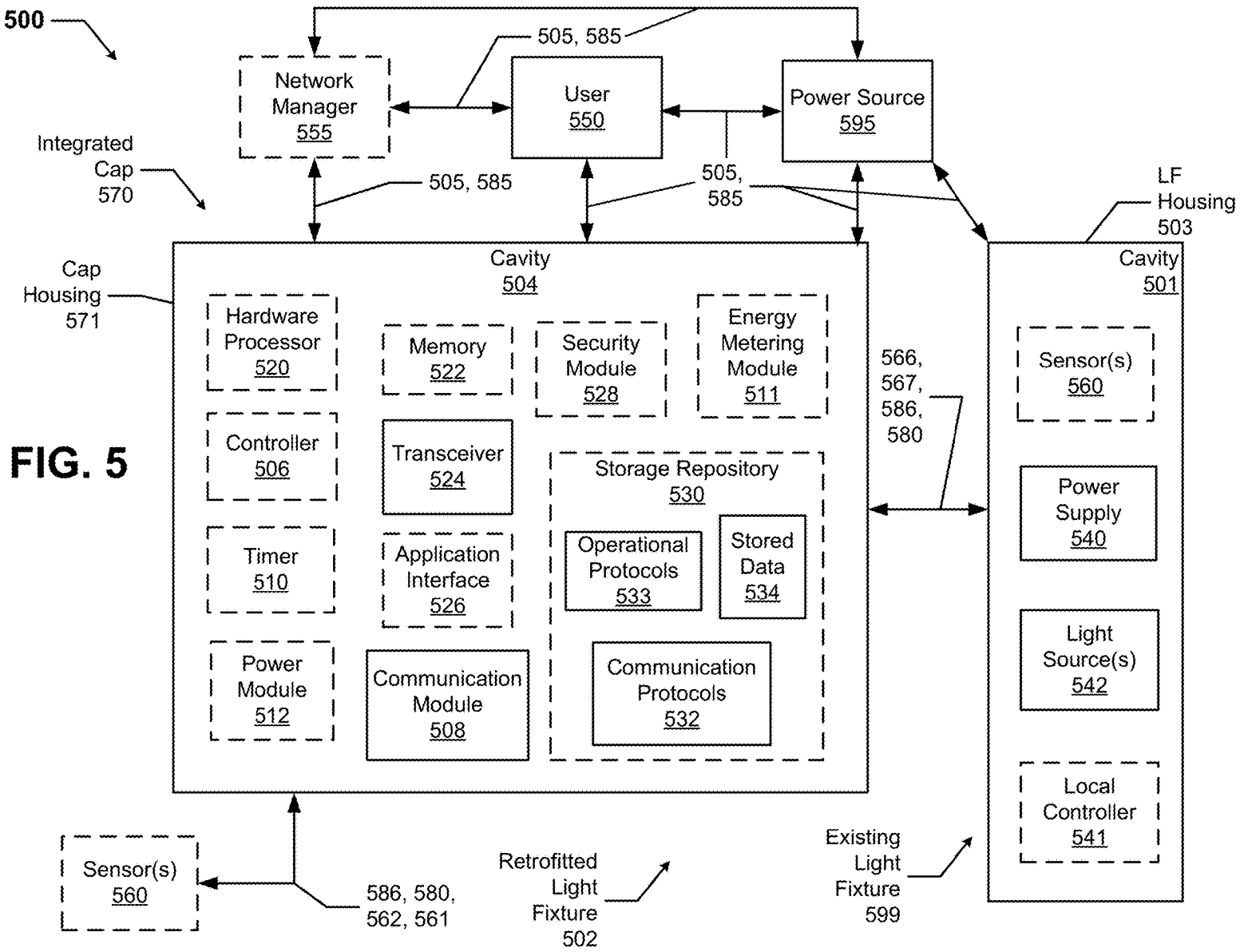
FIG. 5 shows a system diagram of a lighting system that includes an integrated cap in accordance with certain example embodiments.

FIG. 5 shows a system diagram of a lighting system 500 that includes an example integrated cap 570 of a retrofitted light fixture 502 in accordance with certain example embodiments. The lighting system 500 can include a power source 595, a user 550, an optional network manager 555, and the retrofitted light fixture 502. In addition to the integrated cap 570, the retrofitted light fixture 502 can include the components of the existing light fixture 599, such as a power supply 540, a number of light sources 542, an optional local controller 541, and one or more optional sensors 560.

The integrated cap 570 can include one or more of a number of components. Such components, can include, but are not limited to, an optional controller 506, a communication module 508, an optional timer 510, an optional energy metering module 511, an optional power module 512, an optional storage repository 530, an optional hardware processor 520, an optional memory 522, a transceiver 524, an optional application interface 526, and, an optional security module 528. The components shown in FIG. 5 are not exhaustive, and in some embodiments, one or more of the components shown in FIG. 5 may not be included in an example integrated cap 570.

In some cases, one or more of the components of the integrated cap 570 of FIG. 5 can be part of the existing light fixture 599, which in combination creates the retrofitted light fixture 502. For example, the controller 541 of the existing light fixture 599 can control the components of the integrated cap 570. As another example, the existing light fixture 599 can include the local controller 541, and the integrated cap 570 can also include its own controller 506 that communicates with the local controller 541 of the existing light fixture 599. Any component of the example retrofitted light fixture 502 can be discrete or combined with one or more other components of the retrofitted light fixture 502.

The user 550 is the same as a user defined above. The user 550 can use a user system (not shown), which may include a display (e.g., a GUI). The user 550 interacts with (e.g., sends data to, receives data from) the integrated cap 570 of the retrofitted light fixture 502 via the application interface 526 (described below). The user 550 can also interact with the optional network manager 555, the power source 595, the existing light fixture 599, and/or one or more of the sensors 560. Interaction between the user 550, the retrofitted light fixture 502, the network manager 555, the existing light fixture 599, and the sensors 560 can be conducted using signal transfer links 505 and/or power transfer links 585.

Each signal transfer link 505 and each power transfer link 585 can include wired (e.g., Class 1 electrical cables, Class 2 electrical cables, electrical connectors) and/or wireless (e.g., Wi-Fi, visible light communication, cellular networking, Bluetooth, Bluetooth Low Energy (BLE), Zigbee, WirelessHART, ISA100, Power Line Carrier, RS485, DALI) technology. For example, a signal transfer link 505 can be (or include) a wireless link between the integrated cap 570 and the user 550. The signal transfer link 505 can transmit signals (e.g., communication signals, control signals, data) between the retrofitted light fixture 502 and the user 550, the power source 595, the network manager 555, the existing light fixture 599, and/or one or more of the sensors 560. Similarly, a power transfer link 585 can transmit power between the retrofitted light fixture 502 and the user 550, the network manager 580, the existing light fixture 599, and/or one or more of the sensors 560. One or more signal transfer links 505 and/or one or more power transfer links 585 can also transmit signals and power, respectively, between components (e.g., controller 504, sensor 560, switch 570) within the cap housing 571 and within the light fixture housing 503 of the retrofitted light fixture 502. As referred to herein, electrical signals can encompass power signals, communication signals, control signals, data signals, and any other types of similar signals.

The optional network manager 555 is a device or component that controls and/or communicates with all or a portion (e.g., a communication network) of the system 500 that includes the integrated cap 570 of the retrofitted light fixture 502, the power source 595, the user 550, the existing light fixture 599, and the sensors 560. The network manager 555 can be substantially similar to the integrated cap 570, or portions thereof, as described below. For example, the network manager 555 can include a controller. Alternatively, the network manager 555 can include one or more of a number of features in addition to, or altered from, the features of the integrated cap 570 described below. As described herein, communication with the network manager 555 can include communicating with one or more other components (e.g., another light fixture) of the system 500. In such a case, the network manager 555 can facilitate such communication.

The power source 595 of the system 500 provides AC mains or other form of primary power to the retrofitted light fixture 502, as well as to one or more other components (e.g., the network manager 555) of the system 500. The power source 595 can include one or more of a number of components. Examples of such components can include, but are not limited to, an electrical wire (e.g., electrical wire 586), a coupling feature (e.g., coupling feature 587), a transformer, an inductor, a resistor, a capacitor, a diode, a transistor, and a fuse. The power source 595 can be, or include, for example, a wall outlet, an energy storage device (e.g. a battery, a supercapacitor), a circuit breaker, and an independent source of generation (e.g., a photovoltaic solar generation system). The power source 595 can also include one or more components (e.g., a switch, a relay, a controller) that allow the power source 595 to communicate with the user 550, the integrated cap 570, and/or the network manager 555.

As discussed above with respect to FIGS. 4A and 4B, the power source 595 can be coupled to the integrated cap 570. In this case, the power source 595 includes an electrical wire 566, at the distal end of which can be disposed a coupling feature 567. The integrated cap 570 includes a number of electrical wires or conductors 586, disposed within the cap housing 571, and at the distal end of which are disposed a coupling feature 580. Coupling feature 580 can be substantially the same as coupling features 480 discussed above with respect to FIGS. 4A and 4B. Coupling feature 567 and coupling feature 580 are complementary to each other and are detachably coupled to each other. In this way, the AC mains (or other form of primary power), as well as communication signals provided by or through the power source 595 are delivered directly to the integrated cap 570.

The one or more sensors 560 can be any type of sensing device that measure one or more parameters. Examples of types of sensors 560 can include, but are not limited to, a passive infrared sensor, a photocell, a humidity sensor, a pressure sensor, an air flow monitor, and a temperature sensor. Parameters that can be measured by a sensor 560 can include, but are not limited to, movement, occupancy, ambient light, infrared light, and temperature. The parameters measured by the sensors 560 can be used by the controller 506 of the integrated cap 570 and/or the local controller 541 of the existing light fixture 599 to operate the retrofitted light fixture 502.

A sensor 560 can be part of the existing light fixture 599. In such a case, the controller 506 of the integrated cap 570, if one exists, can be configured to communicate with (and in some cases control) the sensor 560. In some other cases, a sensor 560 can be part of the integrated cap 570 (e.g., disposed within the cavity 509 formed by the cap housing 571, disposed on the cap housing 571), where the controller 506 of the integrated cap 570, if one exists, can be configured to communicate with (and in some cases control) the sensor 560. As yet another alternative, a sensor 560 can be a new component that is added to the retrofitted light fixture 502 along with but remotely located with respect to the integrated cap 570, where the controller 506 of the integrated cap 570 and/or the local controller 541 of the existing light fixture 599 can be configured to communicate with (and in some cases control) the added sensor 560. Alternatively, the local controller 541 can communicate with and control the added sensor 560. Each sensor 560 can use one or more of a number of communication protocols 532.

The user 550, the network manager 555, the power source 595, the existing light fixture 599, and/or the sensors 560 can interact with the integrated cap 570 of the retrofitted light fixture 502 using the optional application interface 526 in accordance with one or more example embodiments. Specifically, the application interface 526 of the integrated cap 570 receives data (e.g., information, communications, instructions, updates to firmware) from and sends data (e.g., information, communications, instructions) to the user 550, the network manager 555, the power source 595, the existing light fixture 599, and/or each sensor 560. The user 550, the network manager 555, the power source 595, the existing light fixture 599, and/or each sensor 560 can include an interface to receive data from and send data to the integrated cap 570 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The integrated cap 570, the user 550, the network manager 555, the power source 595, the existing light fixture 599, and/or the sensors 560 can use their own system or share a system in certain example embodiments. Such a system can be, or contain a form of, an Internet-based or an intranet-based computer system that is capable of communicating with various software. A computer system includes any type of computing device and/or communication device, including but not limited to the integrated cap 570. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 6.

Further, as discussed above, such a system can have corresponding software (e.g., user software, sensor software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 500.

The retrofitted light fixture 502 can include a light fixture housing 503, which is substantially the same as the housing 103 of the light fixture 199 of FIG. 1, the housing 203 of FIG. 2, and the housing 303 of FIG. 3 above. The light fixture housing 503 (also sometimes abbreviated LF housing 503) can include at least one wall that forms a light fixture cavity 501 (also sometimes abbreviated LF cavity 501). In some cases, the light fixture housing 503 can be designed to comply with any applicable standards so that the retrofitted light fixture 502 can be located in a particular environment. The light fixture housing 503 can form any type of retrofitted light fixture 502, including but not limited to a street light fixture, a parking light fixture, an open space light fixture, and a walkway post light fixture.

The light fixture housing 503 of the retrofitted light fixture 502 can be used to receive one or more components of the retrofitted light fixture 502, including the integrated cap 570. For example, if the top of the pole has a 7-pin receptacle (a type of coupling feature 567) for a photocell (a type of sensor 560), then the integrated cap 570 (which in this case includes the optional controller 506, the communication module 508, the optional timer 510, the optional energy metering module 511, the optional power module 512, the optional storage repository 530, the optional hardware processor 520, the optional memory 522, the transceiver 524, the optional application interface 526, and the optional security module 528) can have disposed on the cap housing 571 a coupling feature 580 (similar to coupling feature 480-1 of FIG. 4A) that is configured identically to the 7-pin connector of the photocell, thereby allowing the coupling feature 580 of the integrated cap 570 to couple to the coupling feature 567 disposed on the top of the pole.

Similarly, as shown in FIG. 5, the cap housing 571 of the integrated cap 570 can have another coupling feature 580 (similar to coupling feature 480-2 of FIG. 4B) disposed thereon, where the coupling feature 580 is configured as a 7-pin receptacle to receive the 7-pin connector of sensor 560. In this way, the integrated cap 570 acts as an adapter than becomes disposed between the existing sensor 560 and the LF housing 503 to create the retrofitted light fixture 502.

As discussed above, one or more optional sensors 560, the power supply 540, an optional local controller 541, and the light sources 542 can be disposed in the light fixture cavity 501 formed by the housing 503. In alternative embodiments, any one or more of these or other components (e.g., a light source 542) of the retrofitted light fixture 502 can be disposed on the light fixture housing 503 and/or remotely from, but in communication with, the light fixture housing 503.

Similarly, the integrated cap 570 can include a cap housing 571, which is substantially the same as the integrated cap housing 471 described above with respect to FIGS. 4A and 4B. The cap housing 571 can include at least one wall that forms cavity 504. One or more of the various components (e.g., communication module 508, transceiver 524, controller 506, hardware processor 520) of the integrated cap 570 can be disposed within the cavity 504. Alternatively, a component of the integrated cap 570 can be disposed on the cap housing 571 or can be located remotely from, but in communication with, the cap housing 571.

The optional storage repository 530 can be a persistent storage device (or set of devices) that stores software and data used to assist the integrated cap 570 in communicating with the user 550, the network manager 555, the power source 595, the existing light fixture 599, and one or more sensors 560 within the system 500. In some cases, such software and data can be used to control one or more components of the retrofitted light fixture 502. In one or more example embodiments, the storage repository 530 stores one or more communication protocols 532, operational protocols 533, sensor data 534, algorithms, threshold values, default values, user preferences, and any other information that can be used when communicating with another component in the system 500 and/or controlling one or more other components of the retrofitted light fixture 502.

The communication protocols 532 can be any of a number of protocols that are used to send and/or receive data between the integrated cap 570 and the user 550, the network manager 555, the power source 595, the existing light fixture 599, and one or more sensors 560. One or more of the communication protocols 532 can be a time-synchronized protocol. Examples of such time-synchronized protocols can include, but are not limited to, a highway addressable remote transducer (HART) protocol, a wirelessHART protocol, and an International Society of Automation (ISA) 100 protocol. In this way, one or more of the communication protocols 532 can provide a layer of security to the data transferred within the system 500.

The operational protocols 533 can be any algorithms, formulas, logic steps, threshold values, user preferences, and/or other similar operational procedures that the controller 506 of the integrated cap 570 follows based on certain conditions at a point in time. An example of an operational protocol 533 is directing the communication module 508 to communicate with the network manager 555 at pre-set points of time. Another example of an operational protocol 533 is directing the optional controller 506 to control the power supply 540 to adjust the amount of power delivered to the light sources 542, thereby acting as a dimmer. Yet another example of an operational protocol 533 is to instruct the controller 506 how and when to tune the color output by one or more of the light sources 542 of the retrofitted light fixture 502. Still another example of an operational protocol 533 is to check one or more signal transfer links 505 with the network manager 555 and, if a signal transfer link 505 is not functioning properly, allow the integrated cap 570 to operate autonomously from the rest of the system 500.

As another example of an operational protocol 533, configurations of the integrated cap 570 can be stored in optional memory 522 (e.g., non-volatile memory) so that the integrated cap 570 (or portions thereof) can operate regardless of whether the integrated cap 570 is communicating with the network manager 555 and/or other components in the system 500. Still another example of an operational protocol 533 is having a controller (e.g., controller 506, local controller 541) to identify an adverse condition or event (e.g., excessive humidity, high temperature) based on measurements taken by a sensor 560. In such a case, the controller can notify the network manager 555 and/or the user 550 as to the adverse condition or event identified. Yet another example of an operational protocol 533 is to have the integrated cap 570 operate in an autonomous control mode if one or more components (e.g., the communication module 508, the transceiver 524) of the integrated cap 570 that allows the integrated cap 570 to communicate with another component of the system 500 fails.

Sensor data 534 can be any data associated with (e.g., collected by) each sensor 560 that is communicably coupled to the integrated cap 570. Such data can include, but is not limited to, a manufacturer of the sensor 560, a model number of the sensor 560, communication capability of a sensor 560, power requirements of a sensor 560, and measurements taken by the sensor 560. The storage repository 530 can also store any historical, current, and/or future (e.g., forecasts) data associated with the retrofitted light fixture 502. Examples of a storage repository 530 can include, but are not limited to, a database (or a number of databases), a file system, a hard drive, flash memory, some other form of solid state data storage, or any suitable combination thereof. The storage repository 530 can be located on multiple physical machines, each storing all or a portion of the communication protocols 532, the operational protocols 533, and/or the sensor data 534 according to some example embodiments. Each storage unit or device can be physically located in the same or in a different geographic location.

The storage repository 530 can be operatively connected to the optional controller 506 of the integrated cap 570 and/or the optional local controller 541 of the existing light fixture 599. In one or more example embodiments, the controller 506 includes functionality to communicate with the user 550, the network manager 555, the power source 595, the local controller 541, and the sensors 560 in the system 500. More specifically, the controller 506 sends information to and/or receives information from the storage repository 530 in order to communicate with the user 550, the network manager 555, the power source 595, the local controller 541, and the sensors 560. As discussed below, the storage repository 530 can also be operatively connected to the communication module 508 in certain example embodiments.

In certain example embodiments, the controller 506 of the integrated cap 570 embeds a connective device (e.g., a smart node, a WiFi repeater, a pico cell) to allow the retrofitted light fixture 502 to become communicably coupled to at least one other component (e.g., another light fixture, a user 550, the network manager 555) of the system 500. In some cases, the controller 506 of the integrated cap 570 can also control the operation of one or more components (e.g., the communication module 508, the timer 510, the transceiver 524) of the integrated cap 570. For example, the controller 506 can activate the communication module 508 when the communication module 508 is in "sleep" mode and when the communication module 508 is needed to send data received from another component (e.g., a sensor 560, the user 550) in the system 500. As another example, the controller 506 can operate one or more sensors 560 to dictate when measurements are taken by the sensors 560 and when those measurements are communicated by the sensors 560 to the controller 506. As another example, the controller 506 can acquire the current time using the optional timer 510. The timer 510 can enable the integrated cap 570 to control the retrofitted light fixture 502 even when the integrated cap 570 has no communication with the network manager 555.

As another example, the controller 506 can check one or more signal transfer links 505 between the integrated cap 570 and the network manager 555 and, if a signal transfer link 505 is not functioning properly, allow the integrated cap 570 to operate autonomously from the rest of the system 500. As yet another example, the controller 506 can store configurations of the integrated cap 570 (or portions thereof) in memory 522 (e.g., non-volatile memory) so that the integrated cap 570 (or portions thereof) can operate regardless of whether the integrated cap 570 is communicating with the network controller 555 and/or other components in the system 500.

As still another example, the controller 506 can obtain readings from a sensor of an adjacent light fixture if the sensor 560 associated with the retrofitted light fixture 502 malfunctions, if the signal transfer link 505 between the sensor 560 and the integrated cap 570 fails, and/or for any other reason that the readings of the sensor 560 associated with the retrofitted light fixture 502 fails to reach the integrated cap 570. To accomplish this, for example, the network manager 555 can instruct, upon a request from the controller 506, a controller of the adjacent light fixture to communicate its readings to the controller 506 of the integrated cap 570 using signal transfer links 505. As still another example, the controller 506 can cause the integrated cap 570 to operate in an autonomous control mode if one or more components (e.g., the communication module 508, the transceiver 524) of the integrated cap 570 that allows the integrated cap 570 to communicate with another component of the system 500 fails. Similarly, the controller 506 of the integrated cap 570 can control at least some of the operation of one or more adjacent light fixtures in the system 500.

The controller 506 can provide control, communication, and/or other similar signals to the user 550, the network manager 555, the local controller 541, and one or more of the sensors 560. Similarly, the controller 506 can receive control, communication, and/or other similar signals from the user 550, the network manager 555, the power source 595, the local controller 541, and one or more of the sensors 560. The controller 506 can control each sensor 560 automatically (for example, based on one or more algorithms stored in the storage repository 530) and/or based on control, communication, and/or other similar signals received from another device through a signal transfer link 505. The controller 506 may include a printed circuit board, upon which the hardware processor 520 and/or one or more discrete components of the integrated cap 570 are positioned.

In certain example embodiments, the optional controller 506 can include an interface that enables the controller 506 to communicate with one or more components (e.g., the power supply 540, the local controller 541) of the retrofitted light fixture 502. For example, if the power supply 540 of the retrofitted light fixture 502 operates under IEC Standard 62386, then the power supply 540 can include a digital addressable lighting interface (DALI). In such a case, the controller 506 can also include a DALI to enable communication with the power supply 540 within the retrofitted light fixture 502. Such an interface can operate in conjunction with, or independently of, the communication protocols 532 used to communicate between the integrated cap 570 and the user 550, the network manager 555, the power source 595, the local controller 541, and the sensors 560.

The controller 506 (or other components of the integrated cap 570) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

The communication module 508 of the integrated cap 570 determines and implements the communication protocol (e.g., from the communication protocols 532 of the storage repository 530) that is used when the controller 506 communicates with (e.g., sends signals to, receives signals from) the user 550, the network manager 555, the power source 595, the local controller 541, and/or one or more of the sensors 560. In some cases, the communication module 508 accesses the sensor data 534 to determine which communication protocol is used to communicate with the sensor 560 associated with the sensor data 534. In addition, the communication module 508 can interpret the communication protocol of a communication received by the integrated cap 570 so that the controller 506 can interpret the communication.

The communication module 508 can send and receive data between the network manager 555, the power source 595, the local controller 541, and/or the users 550 and the integrated cap 570. The communication module 508 can send and/or receive data in a given format that follows a particular communication protocol 532. The controller 506 can interpret the data packet received from the communication module 508 using the communication protocol 532 information stored in the storage repository 530. The controller 506 can also facilitate the data transfer between one or more sensors 560 and the network manager 555, the power source 595, the local controller 541, and/or a user 550 by converting the data into a format understood by the communication module 508.

The communication module 508 can send data (e.g., communication protocols 532, operational protocols 533, sensor data 534, operational information, error codes, threshold values, algorithms) directly to and/or retrieve data directly from the storage repository 530. Alternatively, the controller 506 can facilitate the transfer of data between the communication module 508 and the storage repository 530. The communication module 508 can also provide encryption to data that is sent by the integrated cap 570 and decryption to data that is received by the integrated cap 570. The communication module 508 can also provide one or more of a number of other services with respect to data sent from and received by the integrated cap 570. Such services can include, but are not limited to, data packet routing information and procedures to follow in the event of data interruption.

The optional timer 510 of the integrated cap 570 can track clock time, intervals of time, an amount of time, and/or any other measure of time. The timer 510 can also count the number of occurrences of an event, whether with or without respect to time. Alternatively, the controller 506 can perform the counting function. The timer 510 is able to track multiple time measurements concurrently. The timer 510 can track time periods based on an instruction received from the controller 506 or the local controller 541, based on an instruction received from the user 550, based on an instruction programmed in the software for the integrated cap 570, based on some other condition or from some other component, or from any combination thereof.

The timer 510 can be configured to track time when there is no power delivered to the integrated cap 570 (e.g., the power module 512 malfunctions) using, for example, a super capacitor or a battery backup. In such a case, when there is a resumption of power delivery to the integrated cap 570, the timer 510 can communicate any aspect of time to the integrated cap 570. In such a case, the timer 510 can include one or more of a number of components (e.g., a super capacitor, an integrated circuit) to perform these functions.

The optional energy metering module 511 of the integrated cap 570 measures one or more components of power (e.g., current, voltage, resistance, VARs, watts) at one or more points (e.g., coupling feature 580 of the integrated cap 570) associated with the retrofitted light fixture 502. The energy metering module 511 can include any of a number of measuring devices and related devices, including but not limited to a voltmeter, an ammeter, a power meter, an ohmmeter, a current transformer, a potential transformer, and electrical wiring. The energy metering module 511 can measure a component of power continuously, periodically, based on the occurrence of an event, based on a command received from the controller 506 and/or the local controller 541, and/or based on some other factor.

The optional power module 512 of the integrated cap 570 provides power to one or more other components (e.g., timer 510, controller 506) of the integrated cap 570. In addition, in certain example embodiments, the power module 512 can provide power to the power supply 540 and/or other components (e.g., a sensor 560) of the existing light fixture 599. The power module 512 can include one or more of a number of single or multiple discrete components (e.g., transistor, diode, resistor), and/or a microprocessor. The power module 512 may include a printed circuit board, upon which the microprocessor and/or one or more discrete components are positioned. In some cases, the power module 512 can include one or more components that allow the power module 512 to measure one or more elements of power (e.g., voltage, current) that is delivered to and/or sent from the power module 512.

If there is no power module 512 for the integrated cap 570, then the power supply 540 of the existing light fixture 599 can provide power to the components of the integrated cap 570. Similarly, if there is no power supply 540 for the existing light fixture 599, then the power module 512 for the integrated cap 570 can provide power to the components of the existing light fixture 599.

The power module 512 can include one or more components (e.g., a transformer, a diode bridge, an inverter, a converter) that receives power (e.g., AC mains) from the power source 595 and/or some other source of power (e.g., external to the retrofitted light fixture 502). The power module 512 can use this power to generate power of a type (e.g., alternating current, direct current) and level (e.g., 12V, 24V, 120V) that can be used by the other components of the integrated cap 570 and the power supply 540. In addition, or in the alternative, the power module 512 can be a source of power in itself to provide signals to the other components of the integrated cap 570 and/or the power supply 540. For example, the power module 512 can be a battery or other form of energy storage device. As another example, the power module 512 can be a localized photovoltaic solar power system.

In certain example embodiments, the power module 512 of the integrated cap 570 can also provide power and/or control signals, directly or indirectly, to one or more of the sensors 560. In such a case, the controller 506 can direct the power generated by the power module 512 to the sensors 560 and/or the power supply 540 of the retrofitted light fixture 502. In this way, power can be conserved by sending power to the sensors 560 and/or the power supply 540 of the retrofitted light fixture 502 when those devices need power, as determined by the controller 506.

The optional hardware processor 520 of the integrated cap 570 executes software, algorithms, and firmware in accordance with one or more example embodiments. Specifically, the hardware processor 520 can execute software on the controller 506 or any other portion of the integrated cap 570, software on the local controller 541 of the existing light fixture 599, and/or software used by the user 550, the network manager 555, the power source 595, and/or one or more of the sensors 560. The hardware processor 520 can be an integrated circuit, a central processing unit, a multi-core processing chip, SoC, a multi-chip module including multiple multi-core processing chips, or other hardware processor in one or more example embodiments. The hardware processor 520 is known by other names, including but not limited to a computer processor, a microprocessor, and a multi-core processor.

In one or more example embodiments, the hardware processor 520 executes software instructions stored in optional memory 522. The memory 522 includes one or more cache memories, main memory, and/or any other suitable type of memory. The memory 522 can include volatile and/or non-volatile memory. The memory 522 is discretely located within the integrated cap 570 relative to the hardware processor 520 according to some example embodiments. In certain configurations, the memory 522 can be integrated with the hardware processor 520.

In certain example embodiments, the integrated cap 570 does not include a hardware processor 520. In such a case, the integrated cap 570 can include, as an example, one or more field programmable gate arrays (FPGA), one or more insulated-gate bipolar transistors (IGBTs), and/or one or more integrated circuits (ICs). Using FPGAs, IGBTs, ICs, and/or other similar devices known in the art allows the integrated cap 570 (or portions thereof) to be programmable and function according to certain logic rules and thresholds without the use of a hardware processor. Alternatively, FPGAs, IGBTs, ICs, and/or similar devices can be used in conjunction with one or more hardware processors 520.

The transceiver 524 of the integrated cap 570 can send and/or receive control and/or communication signals. Specifically, the transceiver 524 can be used to transfer data between the integrated cap 570 and the user 550, the network manager 555, the power source 595, the existing light fixture 599, and/or the sensors 560. The transceiver 524 can use wired and/or wireless technology. The transceiver 524 can be configured in such a way that the control and/or communication signals sent and/or received by the transceiver 524 can be received and/or sent by another transceiver that is part of the user 550, the network manager 555, the power source 595, the existing light fixture 599, and/or the sensors 560. The transceiver 524 can use any of a number of signal types, including but not limited to radio frequency signals and visible light signals.

When the transceiver 524 uses wireless technology, any type of wireless technology can be used by the transceiver 524 in sending and receiving signals. Such wireless technology can include, but is not limited to, Wi-Fi, visible light communication, cellular networking, BLE, Zigbee, and Bluetooth. The transceiver 524 can use one or more of any number of suitable communication protocols (e.g., ISA100, HART) when sending and/or receiving signals. Such communication protocols can be stored in the communication protocols 532 of the storage repository 530. Further, any transceiver information for the user 550, the network manager 555, the power source 595, the existing light fixture 599, and/or the sensors 560 can be part of the communication protocols 532 (or other areas) of the storage repository 530.

Optionally, in one or more example embodiments, the security module 528 secures interactions between the integrated cap 570, the user 550, the network manager 555, the power source 595, the existing light fixture 599, and/or the sensors 560. More specifically, the security module 528 authenticates communication from software based on security keys verifying the identity of the source of the communication. For example, user software may be associated with a security key enabling the software of the user 550 to interact with the integrated cap 570. Further, the security module 528 can restrict receipt of information, requests for information, and/or access to information in some example embodiments.

As mentioned above, aside from the integrated cap 570 and its components, the retrofitted light fixture 502 can include one or more sensors 560, a power supply 540, the optional local controller 541, and one or more light sources 542. The sensors 560 are the same as the sensors 560 described above. The light sources 542 of the retrofitted light fixture 502 are devices and/or components typically found in a light fixture to allow the retrofitted light fixture 502 to operate. The light sources 542 emit light using power provided by the power supply 540. The retrofitted light fixture 502 can have one or more of any number and/or type (e.g., light-emitting diode, incandescent, fluorescent, halogen) of light sources 542. A light source 542 can vary in the amount and/or color of light that it emits.

The power supply 540 of the retrofitted light fixture 502 receives power (also called primary power) from the power source 595 via the integrated cap 570. The power supply 540 uses the power it receives to generate and provide power (also called final power herein) to the sensors 560 and/or one or more of the light sources 542. The power supply 540 can be called by any of a number of other names, including but not limited to a driver, a LED driver, and a ballast. The power supply 540 can include one or more of a number of single or multiple discrete components (e.g., transistor, diode, resistor), and/or a microprocessor. The power supply 540 may include a printed circuit board, upon which the microprocessor and/or one or more discrete components are positioned.

In some cases, the power supply 540 can include one or more components (e.g., a transformer, a diode bridge, an inverter, a converter) that receives power from the integrated cap 570 and generates power of a type (e.g., alternating current, direct current) and level (e.g., 12V, 24V, 120V) that can be used by sensors 560 and/or the light sources 542. In addition, or in the alternative, the power supply 540 can be a source of power in itself. For example, the power supply 540 can or include be a battery, a localized photovoltaic solar power system, or some other source of independent power.

In some cases, the power supply 540 can receive power and/or communication signals from (or controlled by) the integrated cap 570. In such a case, the power supply 540 can be coupled to the one or more electrical wires 566 from the power source 595, where the integrated cap 570, which is disposed therebetween, can control the power and/or communication signals received by the power supply 540. As discussed above, there can also be one or more electrical wires 586 internal to the integrated cap 570 that electrically couple the coupling feature 580 of the integrated cap 570 to one or more components (e.g., the power module 512) within the cavity 504 of the integrated cap 570.

The optional sensors 560 of the existing light fixture 599 can be substantially the same as the sensors 560 discussed above, except that the sensors 560 of the existing light fixture 599 are not directly coupled to the integrated cap 570. The optional local controller 541 can have some or all of the components and/or functionality that are substantially similar to the corresponding components and/or functionality of the controller 506 of the integrated cap 570 described above. In any case, the controller 506 of the integrated cap 570 can be in communication with the optional local controller 541 of the existing light fixture 599. When the retrofitted light fixture 502 includes both the controller 506 and the local controller 541, one controller can be subservient to or co-operate with the other controller.

The retrofitted light fixture 502 (part of the existing light fixture 599 before being retrofitted) can also include one or more of a number of other components. Examples of such other components can include, but are not limited to, a heat sink, an electrical conductor or electrical cable, a terminal block, a lens, a diffuser, a reflector, an air moving device, a baffle, and a circuit board.

As stated above, the retrofitted light fixture 502 can be placed in any of a number of environments. In such a case, the housing 403 of the retrofitted light fixture 502 can be configured to comply with applicable standards for any of a number of environments. For example, the retrofitted light fixture 502 can be rated as a Division 1 or a Division 2 enclosure under NEC standards. Similarly, the integrated cap 570, any of the sensors 560, or other devices communicably coupled to the retrofitted light fixture 502 can be configured to comply with applicable standards for any of a number of environments. For example, a sensor 560 can be rated as a Division 1 or a Division 2 enclosure under NEC standards.

Figure 6:
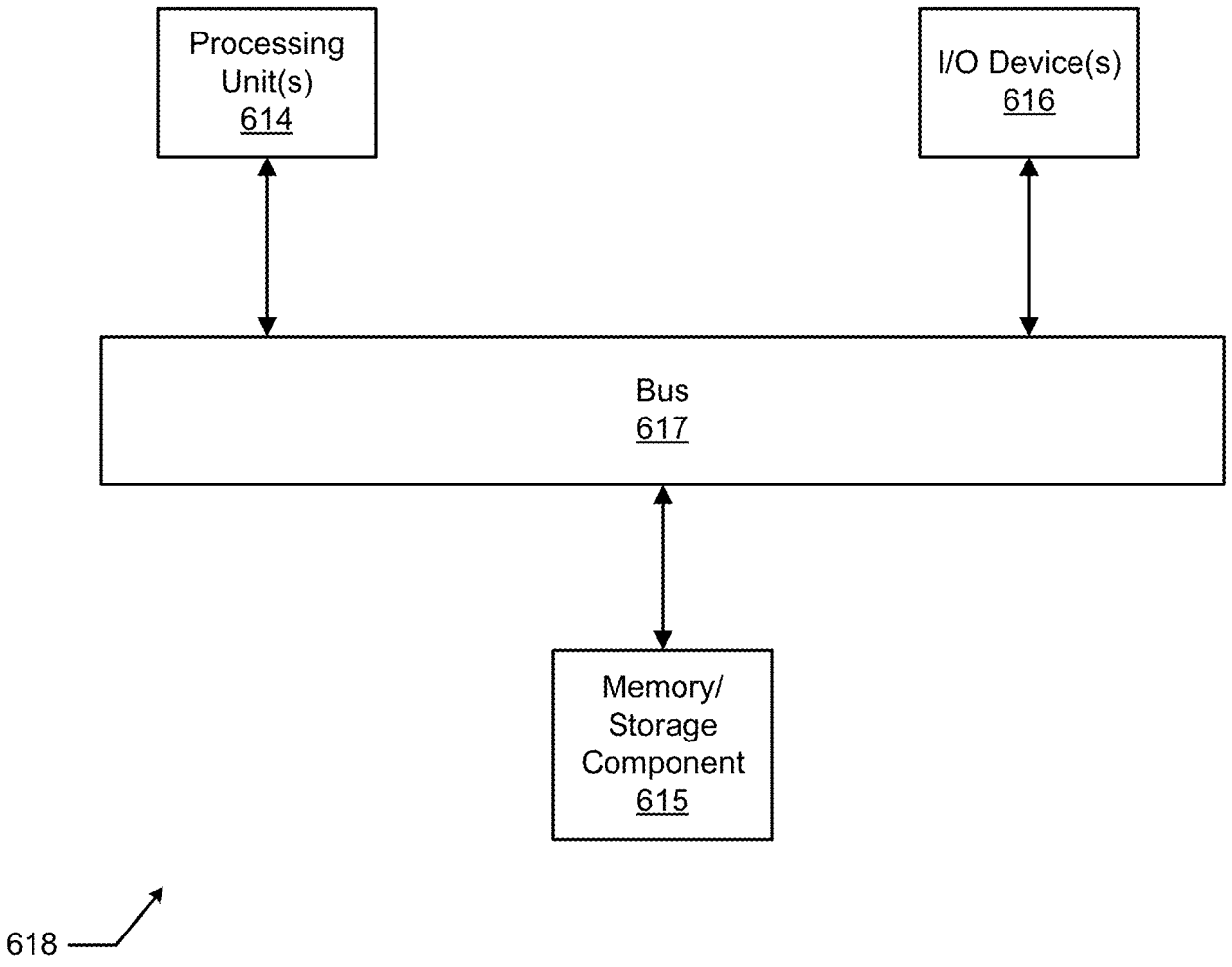
FIG. 6 shows a computing device in accordance with certain example embodiments.

FIG. 6 illustrates one embodiment of a computing device 618 that implements one or more of the various techniques described herein, and which is representative, in whole or in part, of the elements described herein pursuant to certain example embodiments. For example, computing device 618 can be implemented in the integrated cap 570 of FIG. 5 in the form of the hardware processor 520, the memory 522, and the storage repository 530, among other components. Computing device 618 is one example of a computing device and is not intended to suggest any limitation as to scope of use or functionality of the computing device and/or its possible architectures. Neither should computing device 618 be interpreted as having any dependency or requirement relating to any one or combination of components illustrated in the example computing device 618.

Computing device 618 includes one or more processors or processing units 614, one or more memory/storage components 615, one or more input/output (I/O) devices 616, and a bus 617 that allows the various components and devices to communicate with one another. Bus 617 represents one or more of any of several types of bus structures, including a memory bus or memory controller, a peripheral bus, an accelerated graphics port, and a processor or local bus using any of a variety of bus architectures. Bus 617 includes wired and/or wireless buses.

Memory/storage component 615 represents one or more computer storage media. Memory/storage component 615 includes volatile media (such as random access memory (RAM)) and/or nonvolatile media (such as read only memory (ROM), flash memory, optical disks, magnetic disks, and so forth). Memory/storage component 615 includes fixed media (e.g., RAM, ROM, a fixed hard drive, etc.) as well as removable media (e.g., a Flash memory drive, a removable hard drive, an optical disk, and so forth).

One or more I/O devices 616 allow a customer, utility, or other user to enter commands and information to computing device 618, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 618 is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 618 includes at least the minimal processing, input, and/or output means necessary to practice one or more embodiments.

Further, those skilled in the art will appreciate that one or more elements of the aforementioned computer device 618 is located at a remote location and connected to the other elements over a network in certain example embodiments. Further, one or more embodiments is implemented on a distributed system having one or more nodes, where each portion of the implementation (e.g., controller 506) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Example embodiments of integrated caps described herein allow a "dumb" existing light fixture that cannot communicate with other components (e.g., a user, a network manager, another light fixture) of a lighting system to become a "smart" retrofitted light fixture that is capable of such communication. In some cases, example integrated caps can be used to additionally or alternatively control one or more components (e.g., power supply, light sources) of the existing light fixture. Example integrated caps can also prolong the life and functionality of an previously-existing and now-retrofitted light fixture, increase the reliability of the retrofitted light fixture, reduce overall power consumption, improve communication efficiency, have an ease of installation, have an ease of maintenance, and comply with industry standards that apply to light fixtures located in certain environments.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An integrated cap for retrofitting an existing light fixture, the integrated cap comprising:

an integrated cap housing that is configured to be disposed atop an existing pole that supports the existing light fixture, wherein the integrated cap housing comprises at least one first component, wherein the at least one first component comprises a communication module and a transceiver; and a first coupling feature disposed at a bottom end of the integrated cap housing, wherein the first coupling feature is configured to couple to a first complementary coupling feature disposed atop the existing pole of the existing light fixture to provide electrical power from the existing light fixture to the communication module and the transceiver, wherein the communication module and the transceiver, upon receiving the electrical power through the first coupling feature, are configured to communicate with a second component external to the existing light fixture.

2. The integrated cap of claim 1, further comprising:

a second coupling feature disposed at a top end of the integrated cap housing, wherein the second coupling feature is configured to couple to a second complementary coupling feature of a sensor device of the existing light fixture.

3. The integrated cap of claim 2, wherein the sensor device comprises a photocell.

4. The integrated cap of claim 2, wherein the second coupling feature comprises a connector end that is configured to couple to a complementary connector end of the sensor device.

5. The integrated cap of claim 2, wherein the second coupling feature disposed on the integrated end cap housing is configured substantially similar to the first complementary coupling feature of the pole, and wherein the first coupling feature disposed on the integrated end cap housing is configured substantially similar to the second complementary coupling feature of the sensor device.

6. The integrated cap of claim 1, wherein the first coupling feature comprises a first connector end, wherein the first complementary coupling feature comprises a first complementary connector end, and wherein the first connector end is configured to directly couple to the first complementary connector end.

7. The integrated cap of claim 1, wherein the first coupling feature comprises an inductive circuit that induces the electrical power for the at least one first component from a power source external to the integrated cap housing.

8. The integrated cap of claim 1, wherein the transceiver communicates with the second component using wireless technology.

9. The integrated cap of claim 1, wherein the at least one first component of the integrated cap housing further comprises a controller, wherein the controller is configured to control one or more third components of the existing light fixture.

10. The integrated cap of claim 9, wherein the at least one first component of the integrated cap housing further comprises a hardware processor and memory coupled to the controller, wherein the hardware processor executes instructions using the memory.

11. The integrated cap of claim 10, wherein the at least one first component of the integrated cap housing further comprises a storage repository coupled to the controller, wherein the storage repository stores the instructions.

12. The integrated cap of claim 10, wherein the at least one first component of the integrated cap housing further comprises a timer coupled to the controller, wherein the instructions are pre-set schedules of operation for the at least one third component, wherein the pre-set schedules are tracked by the timer.

13. The integrated cap of claim 10, wherein the instructions are for providing the electrical power and ceasing to provide the electrical power to the one or more third components of the existing light fixture.

14. The integrated cap of claim 10, wherein the instructions are for providing a reduced amount of the electrical power to the one or more third components of the existing light fixture.

15. The integrated cap of claim 10, wherein the instructions are for having a light source of the existing light fixture emit a particular color, wherein the light source is among the one or more third components of the existing light fixture.

* * * * *